United States Patent [19]

Kato et al.

[11] Patent Number: 4,518,683

[45] Date of Patent: May 21, 1985

[54] SILVER HALIDE COLOR PHOTOGRAPHIC LIGHT-SENSITIVE MATERIAL

[75] Inventors: Kazuo Kato, Hino; Fumio Hamada, Fussa; Kenji Ito, Hino, all of Japan

[73] Assignee: Konishiroku Photo Industry Co., Ltd., Tokyo, Japan

[21] Appl. No.: 528,114

[22] Filed: Aug. 31, 1983

[30] Foreign Application Priority Data

Sep. 2, 1982 [JP] Japan ..... 57-153551

[51] Int. Cl.[3] ..... G03C 7/26

[52] U.S. Cl. ..... 430/546; 430/523; 430/552; 430/553

[58] Field of Search ..... 430/546, 552, 553, 523

[56] References Cited

U.S. PATENT DOCUMENTS

| | | | |
|---|---|---|---|
| 3,446,622 | 5/1969 | Magagnoli et al. | 430/552 |
| 3,758,308 | 9/1973 | Beavers et al. | 430/553 |
| 4,333,999 | 6/1982 | Lau | 430/17 |
| 4,407,940 | 10/1983 | Nakamura et al. | 430/551 |

*Primary Examiner*—J. Travis Brown

*Attorney, Agent, or Firm*—Finnegan, Henderson, Farabow, Garrett and Dunner

[57] ABSTRACT

A silver halide color photographic light-sensitive material. A support has thereon at least one silver halide emulsion layer and a non-light-sensitive layer adjacent to the silver halide emulsion layer. The silver halide emulsion layer contains a cyan coupler having Formula (I) and a compound having Formula (II). The non-light-sensitive layer contains a compound having Formula (II)

Formula (I):

wherein X is a hydrogen atom or a group which can be split off by the coupling reaction with the oxidized product of an aromatic primary amine color developing agent; $R_1$ is an aryl group or a heterocyclic group; and $R_2$ is a ballasting group necessary to cause the cyan coupler having the Formula (I) and the cyan dye formed from the cyan coupler to be nondiffusible Formula (II):

wherein $R_3$ and $R_4$ each is an alkyl group, an alkenyl group, or a cycloalkyl group each having from 3 to 20 carbon atoms, or an aryl group having from 6 to 20 carbon atoms.

15 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material, and more particularly to a silver halide color photographic light-sensitive material which is improved on the preservability thereof in aging under high temperature/high humidity atmospheric conditions.

2. Description of the State of the Art

It is well known that silver halide color photographic light-sensitive materials are exposed to light and then color-developed in the presence of such a color developing agent as an aromatic primary amine developing agent, whereby dye images are obtained. Namely, when a silver halide color photographic light-sensitive material, after being exposed to light, is color-developed in the presence of an aromatic primary amine developing agent, the developing agent reduces the silver halide to turn it into a developed silver, and at the same time, the agent itself is oxidized to form an active oxidized product of the developing agent, which oxidized product of the developing agent then reacts with couplers to thereby form dyes. The dyes obtained herein are cyan, magenta and yellow dyes, and those which produce these dyes are cyan couplers, magenta couplers and yellow couplers, respectively. Those already known yellow couplers include open-chain ketomethylene compounds, those known cyan couplers include α-naphthol and phenol compounds, and those known magenta couplers include 5-pyrazolone compounds, pyrazolobenzimidazole compounds and pyrazolotriazole compounds.

As the cyan coupler for high-speed silver halide color negative-type photographic light-sensitive materials, naphthol-type couplers have conventionally been used. The naphthol-type couplers have a favorable characteristic that the cyan dye formed by the reaction thereof with the oxidized product of a color developing agent has little subabsorption in the green portion of the longer wavelength region of the absorption spectrum thereof; the little subabsorption being advantageous for color reproductions.

There has been increasingly arising a strong demand for further improvement of image quality in recent years, and to meet such a demand, the improvement on the graininess is essential. As one of the improvement techniques there is known the increase in the coating amount of silver.

However, the increase in the coating amount of silver produces such a large drawback that, in the case of a silver halide color photographic light-sensitive material containing a conventional naphthol-type cyan coupler, the dye formed therefrom, in the process of bleaching or bleach-fixing the developed silver, is reduced to be discolored due to a large amount of ferrous ions.

On the other hand, as the coupler that causes no reduction discoloration of the cyan dye formed therefrom in the bleaching or bleach-fixing process, there are known those phenol-type couplers having at the second position thereof a ureido group as described in, e.g., Japanese Patent Publication Open to Public Inspection (hereinafter referred to as Japanese Patent O.P.I. Publication) No. 65134/1981, and it is also found that a favorable maximum absorption wavelength and less absorption of the green portion may be realized by the use of them in combination with compounds of a phthalic acid ester as formulated in Formula [II] relating to the invention, which will be described later.

Thus, there is no abovementioned drawback in a silver halide color photographic light-sensitive material containing in the light-sensitive silver halide emulsion layer thereof a phenol-type cyan coupler having at the second position thereof a ureido group and a compound of a phthalic acid ester, but unfortunately it has been found there is such a serious disadvantage in practical use that when the undeveloped sample is allowed to stand over an extensive period under a high temperature/high humidity atmospheric condition (e.g., 40° C./80% for a week), there occurs the deteriorations of the maximum color density and of the sensitivity.

Accordingly, there has been a strong demand for the development of a silver halide color photographic light-sensitive material which is such that the coating amount of silver is increased for the improvement of the graininess thereof, the dye formed therefrom is not discolored in the bleaching or bleach-fixing process, and it has a photographically desirable spectral absorption characteristic and excellent in the preservability thereof in aging under high temperature/high humidity atmospheric conditions.

OBJECT OF THE INVENTION

It is therefore an object of the present invention to provide a silver halide color photographic light-sensitive material which is improved on the graininess thereof, the dye formed from which is not discolored in the bleaching or bleach-fixing process and has a photographically desirable spectral absorption characteristic, and which is excellent in the preservability thereof in aging under high temperature/high humidity atmospheric conditions.

DETAILED DESCRIPTION OF THE INVENTION

The above object, as a result of our continued study, is accomplished by a silver halide color photographic light-sensitive material (hereinafter referred to as "color light-sensitive material") which comprises a support having thereon a silver halide emulsion layer (hereinafter referred to as "emulsion layer") containing at least one of those couplers having the following Formula [I] (hereinafter referred to as "cyan coupler of the invention") and at least one of those compounds having the following Formula [II] (hereinafter referred to as "compound of the present invention"), and a nonlight-sensitive layer adjacent to the above-mentioned emulsion layer (hereinafter referred to as "nonlight-sensitive layer") containing at least one of the compounds of the present invention.

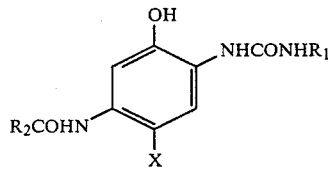

Formula [I]

wherein X is a hydrogen atom or a group which can be split off during the coupling reaction thereof with the oxidized product of an aromatic primary amine developing agent; $R_1$ is an aryl group such as phenyl, naphthyl or heterocyclic group; and $R_2$ is a ballasting group necessary to cause the cyan coupler having Formula [I] and the cyan dye formed therefrom to be nondiffusible.

$R_1$ is preferably a naphthyl group, a heterocyclic group (provided the carbon atom of the heterocyclic group is coupled to the nitrogen group of a ureido group) or a phenyl group having at least one substituent selected from the class consisting of trifluoromethyl, nitro, cyano, —COR, —COOR, $—SO_2R$, $—SO_2OR$,

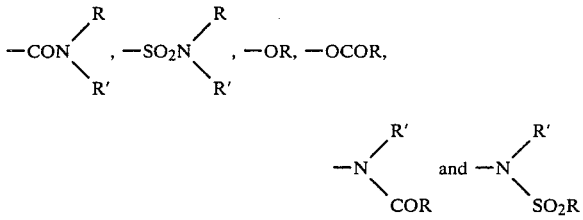

wherein R is an aliphatic group or an aromatic group; R′ is a hydrogen atom, an aliphatic or aromatic group; and R and R′ may couple to each other to form a 5- or 6-member ring.

The preferred cyan couplers of the present invention, to be concrete, are those having the following Formula [Ia] or [Ib]:

Formula [Ia]

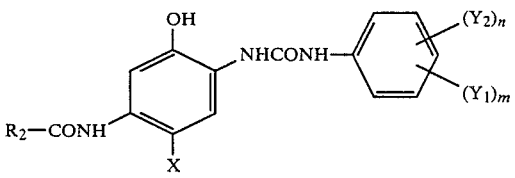

Formula [Ib]

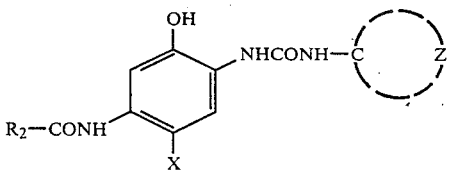

wherein $Y_1$ is trifluoromethyl, nitro, cyan or a group represented by —COR, —COOR, $—SO_2R$, $—SO_2OR$,

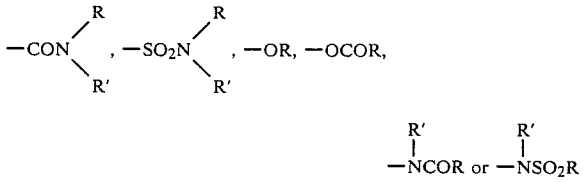

wherein R is an aliphatic group [preferably an alkyl group having from 1 to 10 carbon atoms (such as, e.g., methyl, butyl, cyclohexyl, benzyl, etc.)] or an aromatic group (preferably a phenyl group such as, e.g., phenyl, tolyl, etc.); R′ is a hydrogen atom or one of the groups represented by R; and R and R′ may couple to each other to form a 5- or 6-member ring.

$Y_2$ is a monovalent group, preferably an aliphatic group [preferably an alkyl group having from 1 to 10 carbon atoms (such as, e.g., methyl, t-butyl, ethoxyethyl, cyanomethyl)], an aromatic group [preferably a phenyl (such as phenyl, tolyl, or naphthyl group)], a halogen atom (such as fluorine, chlorine, or bromine), an amino group (such as, e.g., ethylamino group, diethylamino group), hydroxy group, or a substituent represented by $Y_1$.

m is an integer of from 1 to 3, n is an integer of 0 to 3,

Z is a group of nonmetallic atoms necessary to form a heterocyclic group or naphthyl group. The preferred heterocyclic group is a 5- or 6-member heterocyclic ring containing from 1 to 4 nitrogen, oxygen or sulfur atoms, the heterocyclic group being such as furyl group, enyl group, pyridyl group, quinolyl group, oxazolyl group, tetrazolyl group, benzothiazolyl group, tetrahydrofuranyl group or the like.

In addition, into these rings may be introduced any arbitrary substituent such as, e.g., an alkyl group having from 1 to 10 carbon atoms (such as, e.g., ethyl, i-propyl, i-butyl, t-butyl, t-octyl, etc.), an aryl group (such as phenyl, naphthyl, etc.), a halogen atom (such as fluorine, chlorine, bromine, etc.), cyano group, nitro group, a sulfonamido group (such as, e.g., methanesulfonamido, butanesulfonamido, p-toluenesulfonamido, etc.), a sulfamoyl group (such as, e.g., methyl-sulfamoyl, phenyl-sulfamoyl, etc.), a sulfonyl group (such as, e.g., methanesulfonyl, p-toluenesulfonyl, etc.), fluorosulfonyl group, a carbamoyl group (such as, e.g., dimethyl-carbamoyl, phenyl-carbamoyl, etc.), an oxycarbonyl group (such as, e.g., ethoxycarbonyl, phenoxycarbonyl, etc.), an acyl group (such as, e.g., acetyl group, benzoyl group, etc.), a heterocyclic group (such as, e.g., pyridyl group, pyrazolyl group, etc.), an alkoxy group, an aryloxy group, an acyloxy group, or the like.

$R_2$ represents an aliphatic or aromatic group necessary to cause the cyan coupler having Formula [I] and the cyan dye formed therefrom to be nondiffusible, and is preferably an alkyl, aryl or heterocyclic group having from 4 to 30 carbon atoms, such as, e.g., a straight-chain or branched-chain alkyl group (such as, e.g., t-butyl, n-octyl, t-octyl, n-dodecyl, etc.), an alkenyl group, a cycloalkyl group, a 5- or 6-member heterocyclic ring, a group having Formula [Ic], or the like.

Formula [Ic]

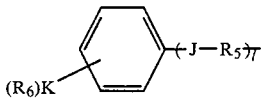

wherein J is an oxygen atom or a sulfur atom; K is an integer of up to 4; l is 0 or 1; if K is not less than 2, the not less than two $R_6$s each may be either the same or different; $R_5$ is a straight-chain or branced-chain alkylene group having from 1 to 20 carbon atoms; $R_6$ is a monovalent group such as, e.g., a halogen atom (preferably chlorine or bromine), an alkyl [preferably a straight-chain or branched-chain alkyl having from 1 to 20 carbon atoms (such as, e.g., methyl, tert-butyl, tert-pentyl, tert-octyl, dodecyl, pentadecyl, benzyl, phenethyl)], an aryl group (such as phenyl), a heterocyclic group (preferably a nitrogen-containing heterocyclic group), an alkoxy group [preferably a straight-chain or branched-chain alkyloxy group having from 1 to 20 carbon atoms (such as, e.g., methoxy, ethoxy, tert-butyloxy, octyloxy, decyloxy, dodecyloxy)], an aryloxy group (such as phenoxy), hydroxy group, an acyloxy group [preferably an alkylcarbonyloxy group (such as an acetoxy), an arylcarbonyloxy group (such as, e.g., benzoyloxy)], carboxy group, an alkoxycarbonyl group (preferably a straight-chain or branched-chain alkyloxycarbonyl group having from 1 to 20 carbon atoms), an aryloxycarbonyl group (preferably a phenoxycarbonyl), an alkylthio group (preferably those having from 1 to 20 carbon atoms), an acyl group (preferably a straight-chain or branched-chain alkylcarbonyl group having from 1 to 20 carbon atoms), an acylamino group (preferably a straight-chain or branched-chain alkylcarboamido, benzenecarboamido having from 1 to 20 carbon atoms), a sulfonamido group (preferably a straight-chain or branched-chain alkylsulfonamido group or benzenesulfonamido group having from 1 to 20 carbon atoms), a carbamoyl group (preferably a straight-chain or branched-chain alkylaminocarbonyl group or phenylaminocarbonyl group having from 1 to 20 carbon atoms), a sulfamoyl group (preferably a straight-chain or branched-chain alkylaminosulfonyl group or phenylaminosulfonyl group having from 1 to 20 carbon atoms), or the like.

X is hydrogen or a group which can be split off during the coupling reaction with the oxidized product of a color developing agent, such as, e.g., a halogen atom (e.g., chlorine, bromine, fluorine), an aryloxy group, carbamoyloxy group, carbamoylmethoxy group, acyloxy group, sulfonamido group, succinic acid imido group, or the like, to which is directly coupled at the coupling position an oxygen atom or a nitrogen atom, and further concrete examples thereof are those as described in U.S. Pat. No. 3,741,563, Japanese Patent O.P.I. Publication No. 37425/1972, Japanese Patent Examined Publication No. 36894/1973, Japanese Patent O.P.I. Publication Nos. 10135/1975, 117422/1975, 130441/1975, 108841/1976, 120334/1975, 18315/1977, 105226/1978, and the like.

Any of the cyan couplers of the present invention may be easily synthesized by use of those methods as described in, e.g., U.S. Pat. No. 3,758,308, and Japanese Patent O.P.I. Publication No. 65134/1981.

The following are examples of the preferred compounds of the present invention, but the present invention is not limited thereto.

A-1

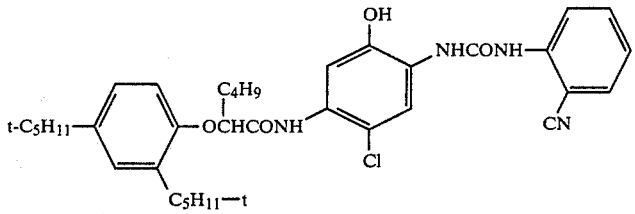

A-2

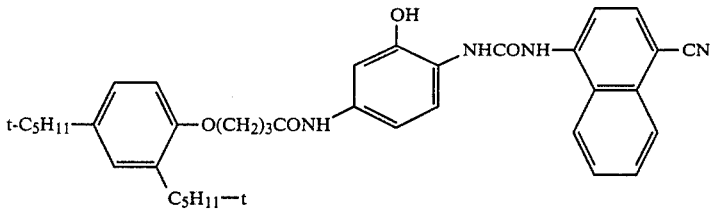

A-3

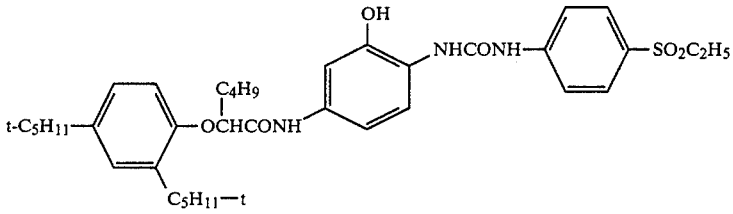

A-4

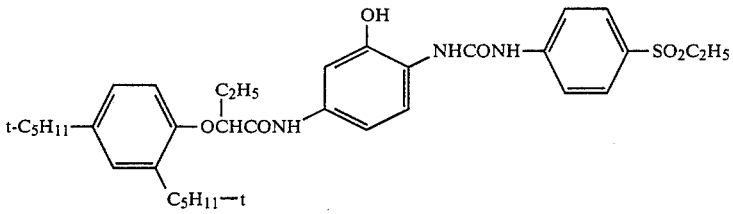

-continued
A-5
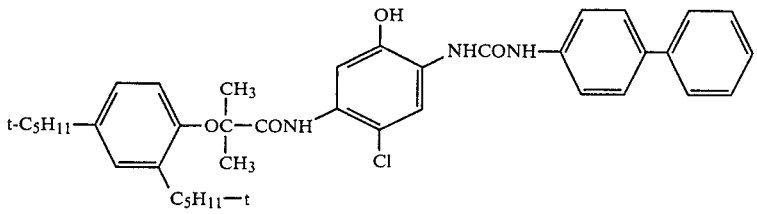
A-6
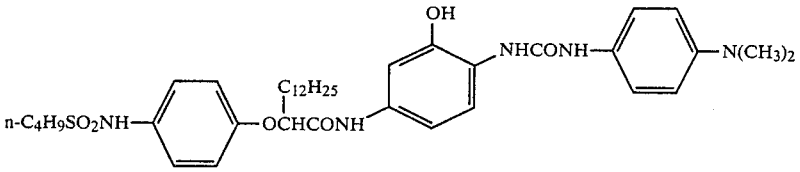
A-7
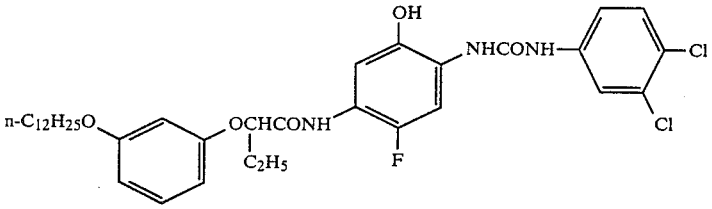
A-8
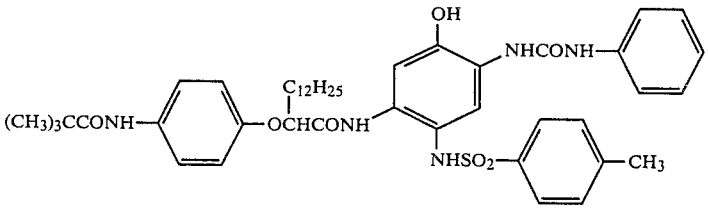
A-9
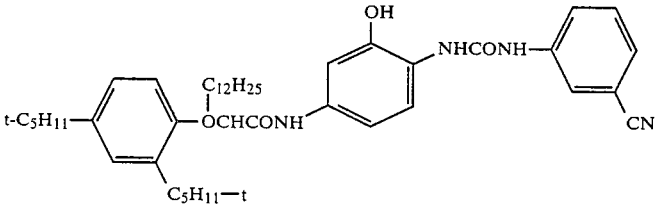
A-10
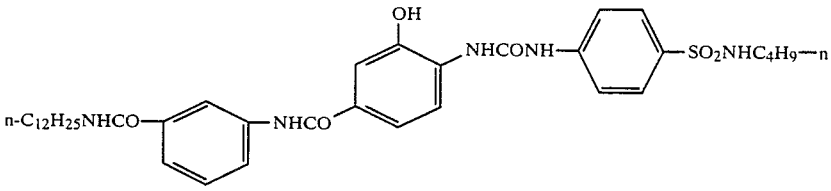
A-11
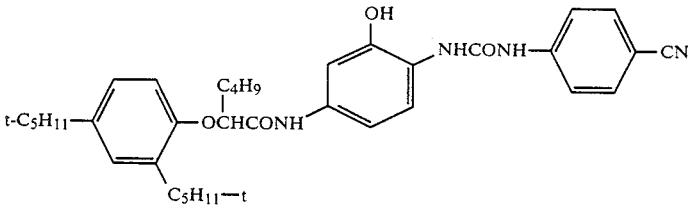

-continued
A-12
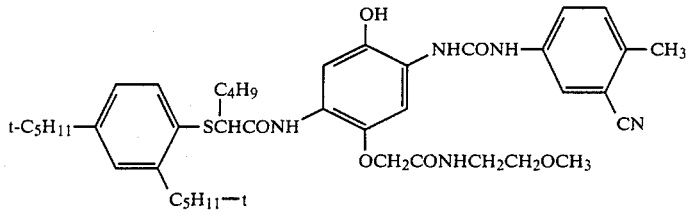
A-13
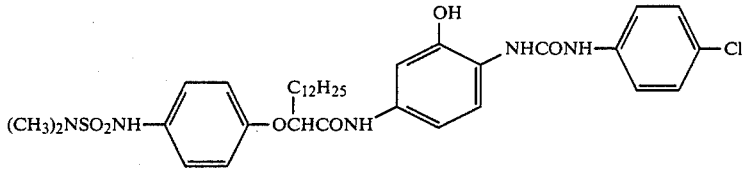
A-14
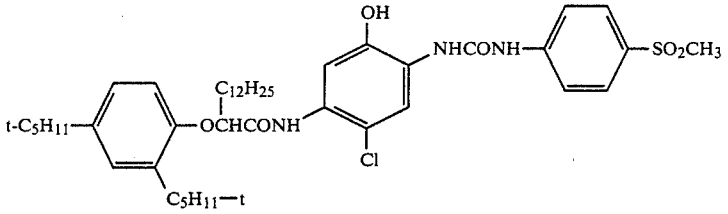
A-15
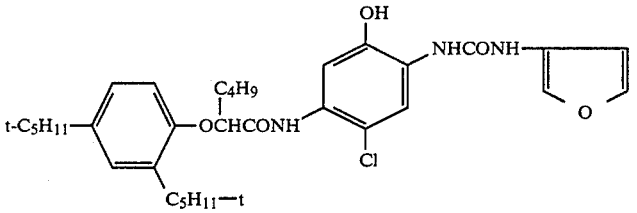
A-16
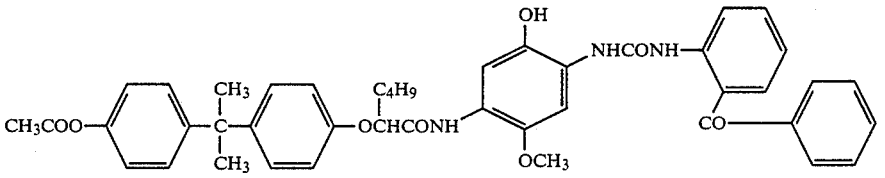
A-17
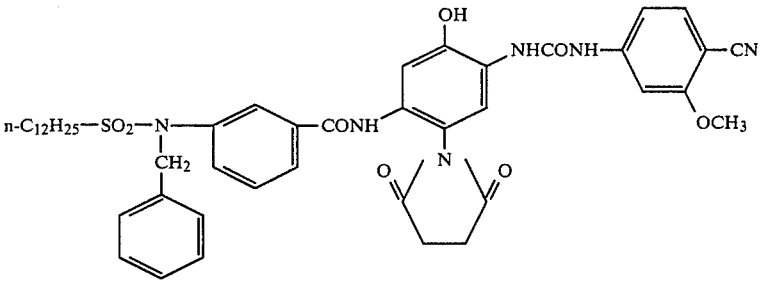
A-18
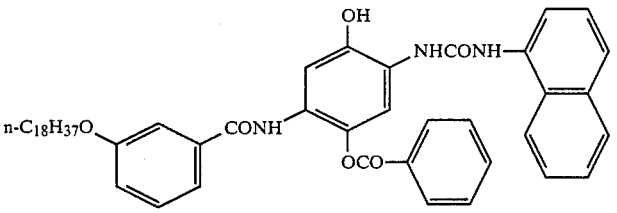

-continued
A-19
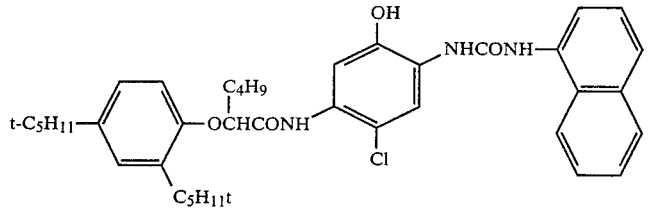
A-20
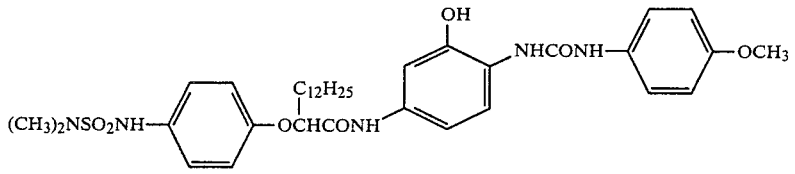
A-21
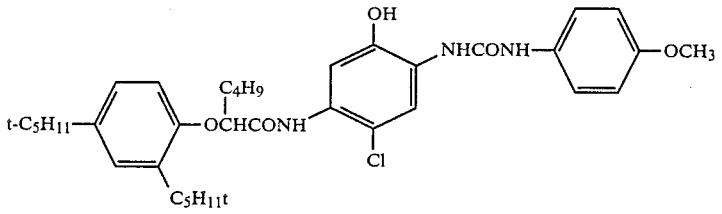
A-22
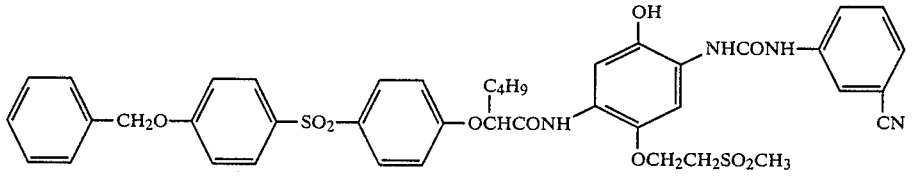
A-23
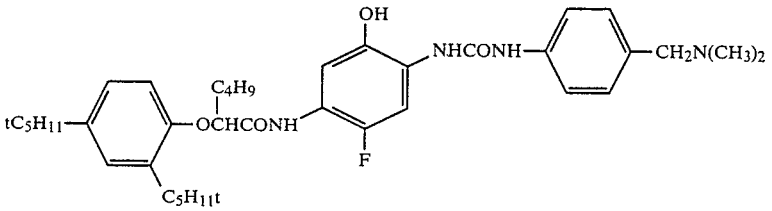
A-24
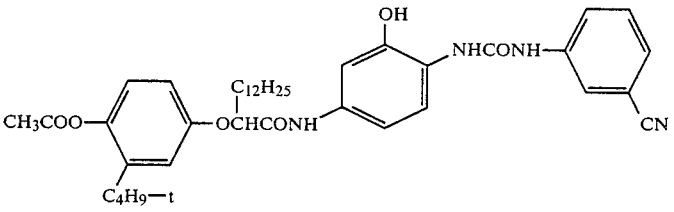
A-25
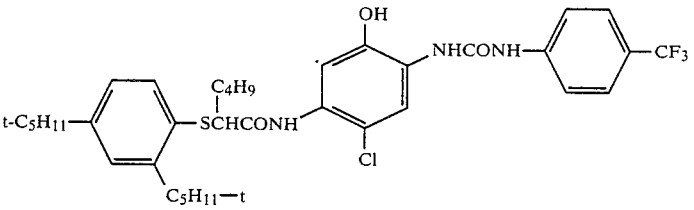

-continued
A-26
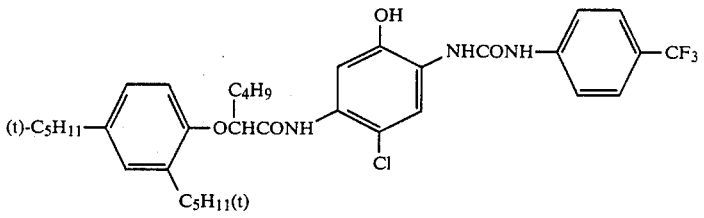
A-27
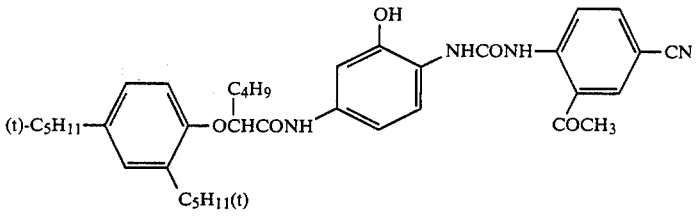
A-28
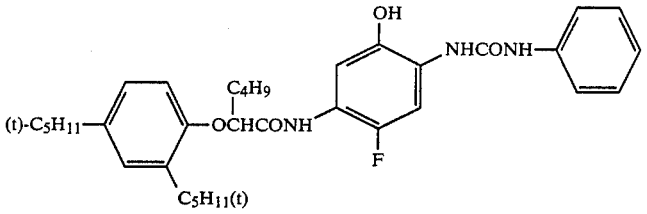
A-29
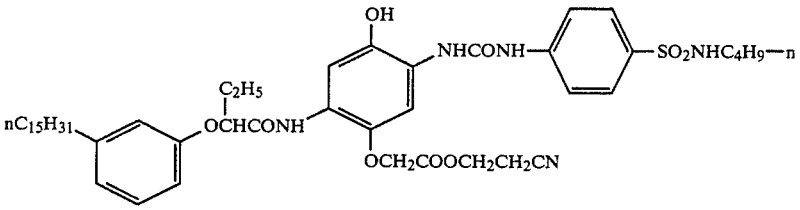
A-30
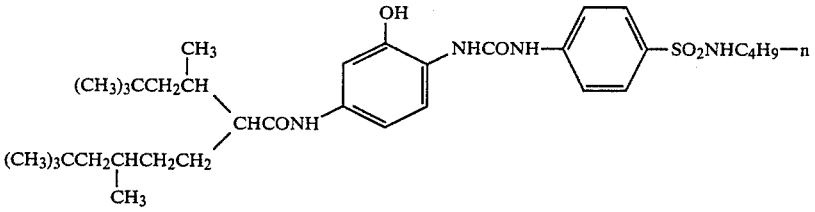
A-31
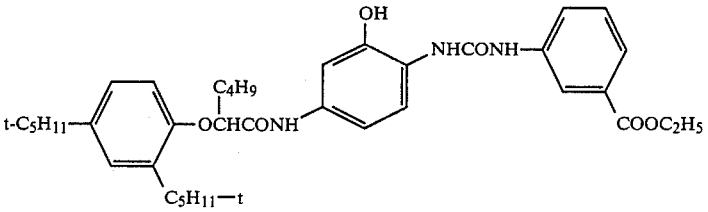
A-32
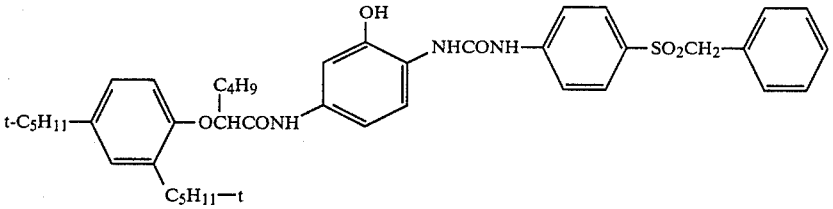

-continued
A-33
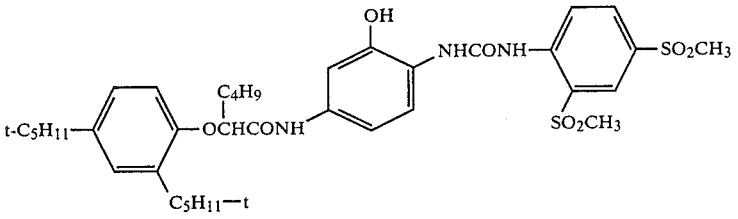
A-34
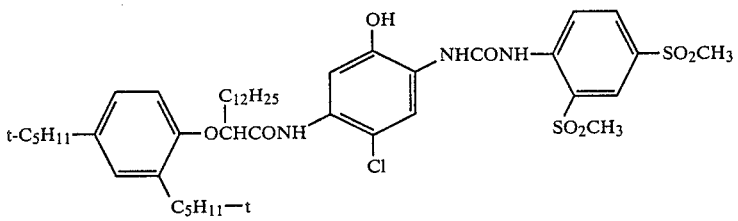
A-35
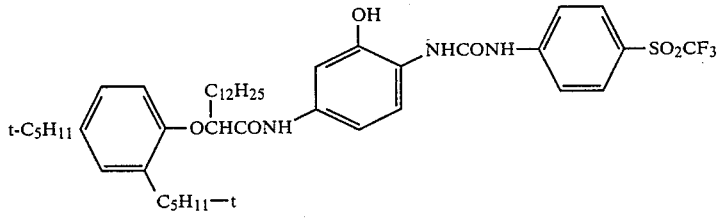
A-36
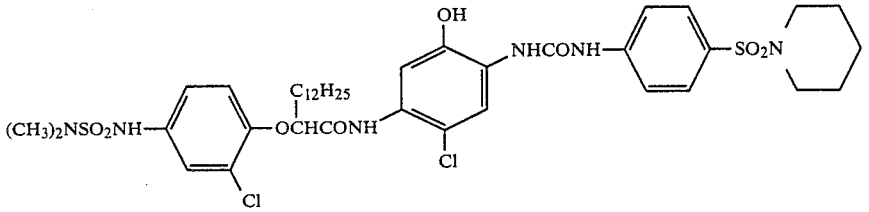
A-37
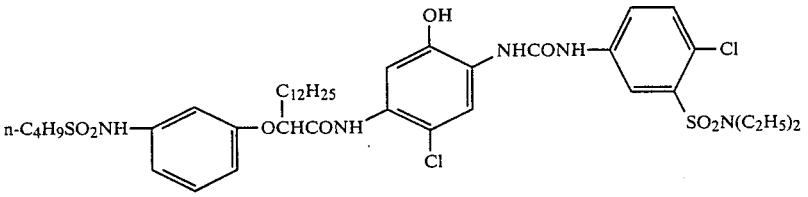
A-38
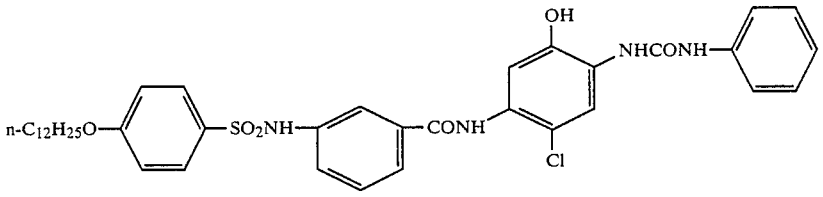
A-39
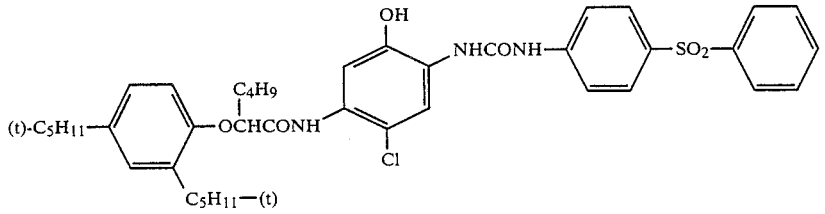

-continued
A-40
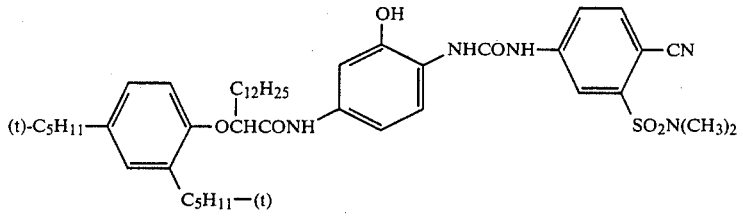
A-41
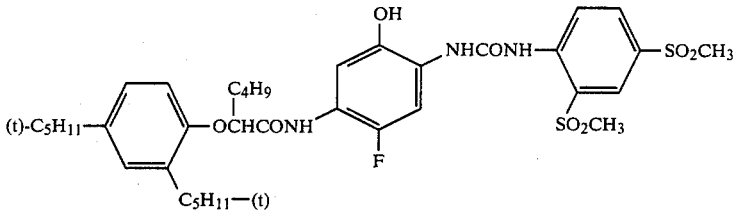
A-42
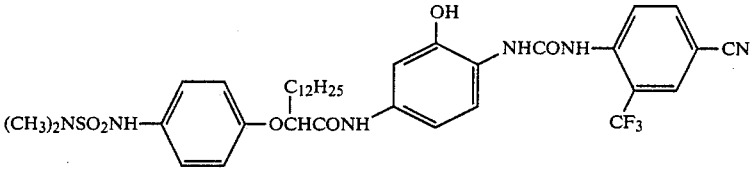
A-43
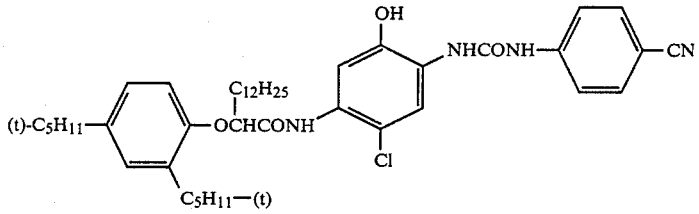
A-44
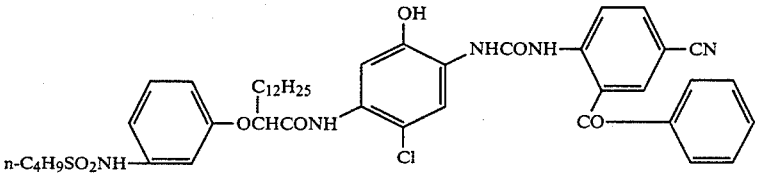
A-45
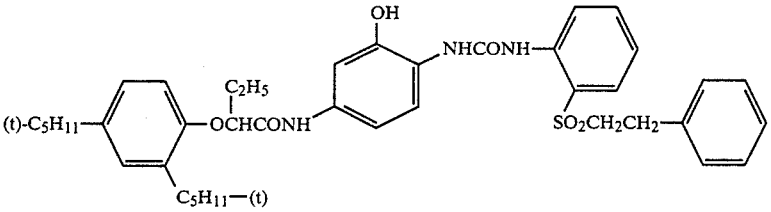
A-46
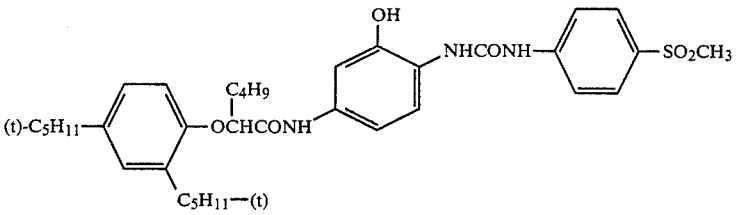

-continued
A-47
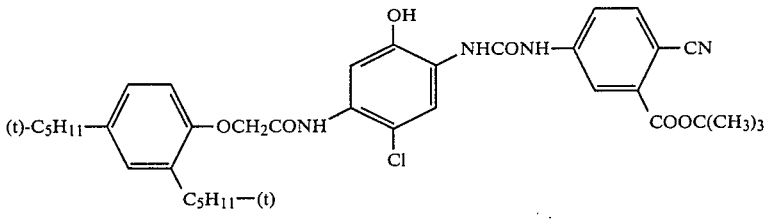
A-48
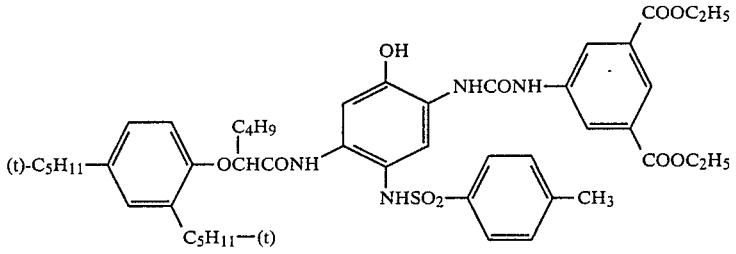
A-49
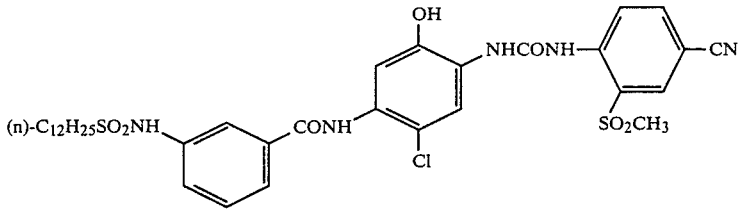
A-50
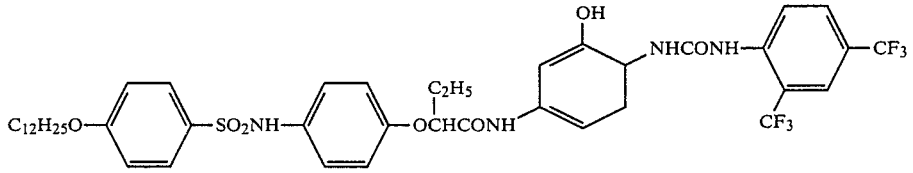
A-51
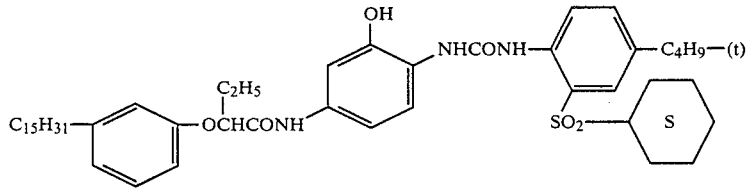
A-52
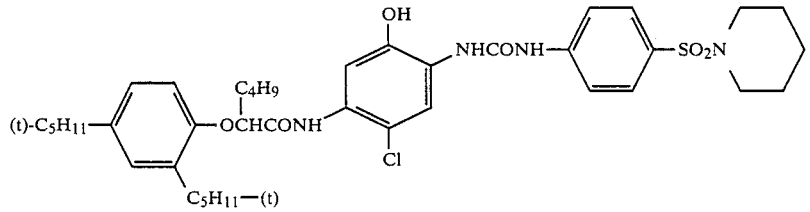
A-53
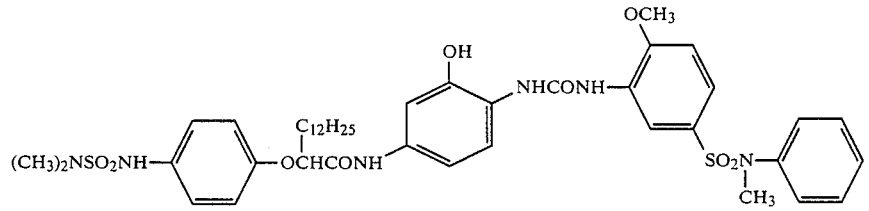

-continued

A-54

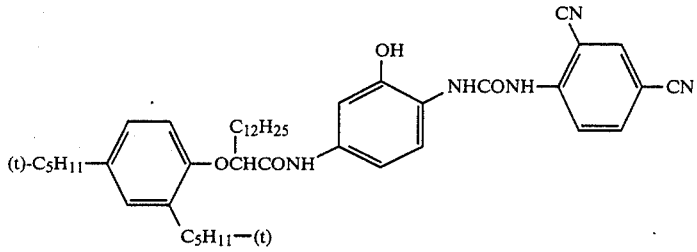

A-55

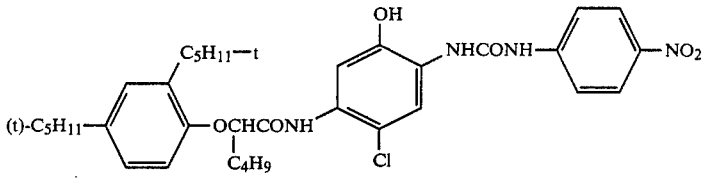

A-56

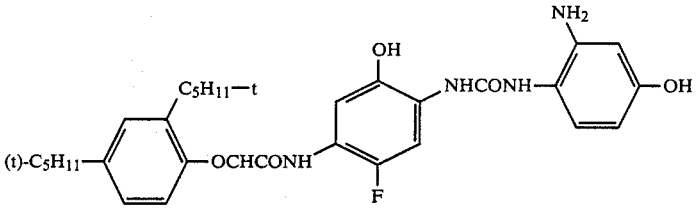

A-57

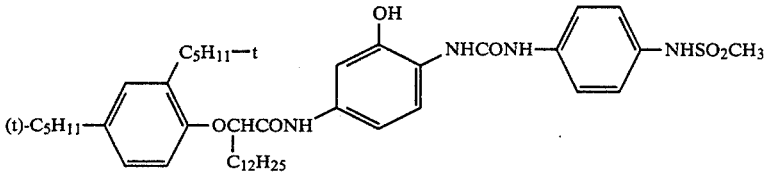

A-58

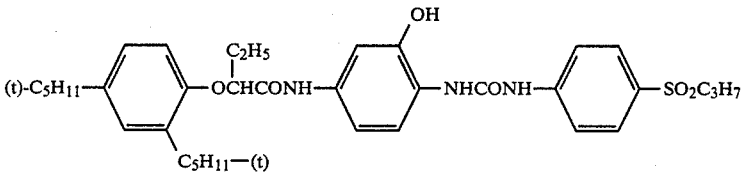

A-59

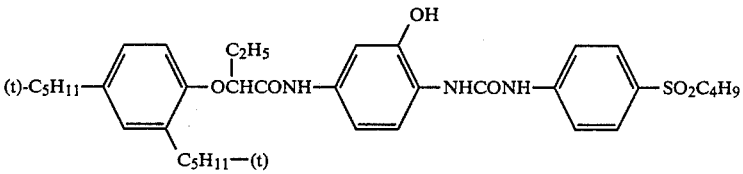

Next, the compounds of the present invention have the following Formula [II]

Formula [II]

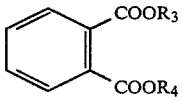

wherein $R_3$ and $R_4$ each represents an alkyl, alkenyl or cycloalkyl group each having from 3 to 20 carbon atoms or an aryl group having from 6 to 20 carbon atoms.

The preferred compounds of the present invention are those whose $R_3$ and $R_4$ each is a straight-chain or branched-chain alkyl group having from 4 to 12 carbon atoms (such as, e.g., n-butyl, sec-butyl, n-hexyl, sec-octyl, n-dodecyl, etc.) or an aryl group having from 6 to 12 carbon atoms (such as phenyl or tolyl), and particularly preferred compounds are those whose $R_3$ and $R_4$ are the same and each is a straight-chain or branched-chain alkyl having from 4 to 12 carbon atoms.

The following are examples of the compounds of the present invention is not limited thereto:

P-1

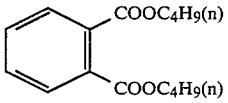

P-2

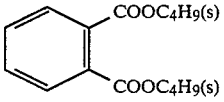

-continued

P-3

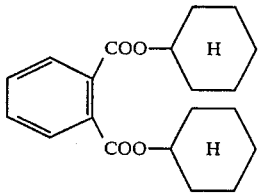

P-4

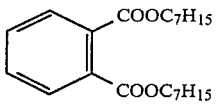

P-5

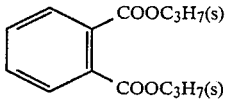

P-6

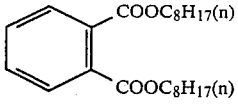

P-7

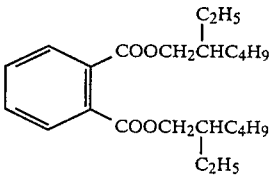

P-8

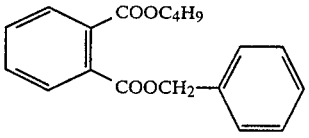

P-9

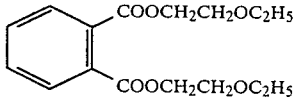

P-10

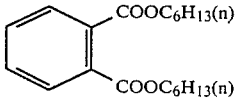

P-11

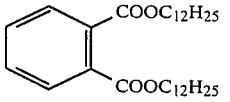

P-12

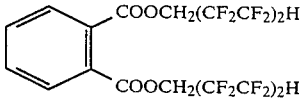

P-13

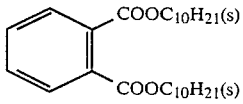

-continued

P-14

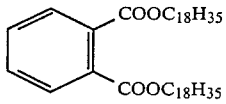

P-15

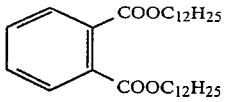

P-16

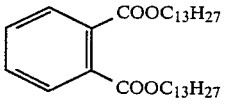

P-17

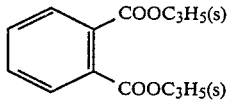

P-18

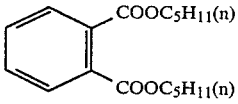

P-19

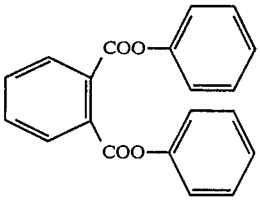

P-20

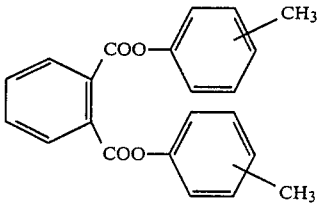

These compounds are commercially available.

In the invention, the incorporation of at least one of the aforesaid cyan couplers of the present invention into an emulsion layer may be made in such the manner as described in U.S. Pat. No. 2,322,027, and the like. For example, one of the cyan couplers of the present invention is dissolved into a single high boiling solvent or a mixture of two or more high boiling solvents each having a boiling point of not less than 175° C., such as dibutyl phthalate, dioctyl phthalate, triphenyl phosphate, tricresyl phosphate, phenoxyethanol, diethylene glycol monoethylether, diethoxyethyl phthalate, diethyl laurylamide, diethyl laurylamide, and the like, or into a single low boiling solvent or a mixture of low boiling solvents such as butyl acetate, methanol, ethanol, butanol, acetone, $\beta$-ethoxydiethyl acetate, methoxytriglycol acetate, dioxane, fluorinated alcohol, and the like, and the solution is then mixed with an aqueous gelatin solution containing a surface active agent and emulsified to be dispersed by means of a high-speed rotary mixer or colloid mill. The dispersed liquid is then either directly added to an emulsion layer or is set and finely cut into pieces to be washed to remove the low boiling solvent therefrom and then added to an emulsion; or if alkali-soluble, the coupler may also be added by the so-called Fischer dispersion method.

In order to incorporate at least one of the aforesaid compounds of the invention into an emulsion layer, the compound of the invention, as described above, may be added in the form of a single dispersed liquid, but is more desirable to be mixed with a high boiling solvent solution of another cyan coupler of the invention and then added in the form of an emulsifiedly dispersed mixture liquid to an emulsion layer. In this instance, the compound of the present invention and the foregoing high boiling solvent are allowed to be mixed to be used.

The incorporation of the compound of the present invention into a nonlight-sensitive layer may also be made in the same manner as described above.

In this instance, the compounds of the present invention may be used in the form of a mixture of not less than two thereof, and may also be used by mixing them into the foregoing high boiling solvent.

Even when a color light-sensitive material of the invention is preserved with the lapse of time in an atmospheric condition of high temperature and humidity, a dye image having particularly stable maximum density and sensitivity may be obtained from a color light-sensitive material in which a phenol-type cyan coupler relating to the invention and a compound relating to the invention are incorporated into the silver halide emulsion layer thereof and further a compound relating to the invention is incorporated into the non-light-sensitive layer thereof in the process described in detail as above.

The nonlight-sensitive layer of the invention will be detailedly described later, but it should be contiguous to the emulsion layer of the invention and is allowed to be located, with respect to the emulsion layer, closer to or farther from the support, but is more desirable to be located farther than the emulsion layer from the support. In addition, both of the emulsion layers are also allowed to be nonlight-sensitive layers.

The adding quantities of the cyan coupler of the invention and of the compound of the invention to the emulsion layer are such that the cyan coupler of the present invention should be added in a quantity of from about $5\times10^{-3}$ to about $5\times10^{5}$ moles, and more preferably from $1\times10^{-2}$ to 1.0 mole per mole of silver halide, and the compound of the invention should be added in a quantity of from about 0.1 to about 10 g, and more preferably from 0.2 to 3 g per gram of the cyan coupler of the invention. And the adding quantity of the compound of the invention to the nonlight-sensitive layer of the invention is from about 5% to about 500%, and more preferably from 20% to 200% of the adding quantity per unit area of the compound of the invention to the above-mentioned emulsion layer.

The present invention may be used in a monochromatic color light-sensitive material, and may also be used as a multicolor light-sensitive material. Normally, a multicolor light-sensitive material has dye image forming component units which are sensitive, respectively, to the respective three primary color regions of the spectrum, and each of the units is comprised of a single emulsion layer or of a plurality of emulsion layers sensitive to a definite region of the spectrum (the plurality of emulsion layers are desirable to be different in their speed), and the light-sensitive material may also have a filter layer, internal protective layer, subbing layer and the like, for example. The layers including each of the abovementioned image forming component unit layers of the light-sensitive material may be coated in various order as is known to those skilled in the art. For example, in a multicolor light-sensitive material, the silver halide emulsion layer containing the cyan coupler and compound of the present invention is usually red-sensitive, but may not necessarily be red-sensitive.

A typical multicolor light-sensitive material comprises a support coated thereover with a cyan dye image forming component unit consisting of at least one red-sensitive silver halide emulsion layer containing at least one cyan dye forming coupler, a magenta dye image forming component unit consisting of at least one green-sensitive silver halide emulsion layer containing at least one magenta dye forming coupler, and a yellow dye image forming component unit consisting of at least one blue-sensitive silver halide emulsion layer containing together at least one yellow dye forming coupler, and other nonlight-sensitive layers.

To this multicolor light-sensitive material may be applied known 2-equivalent or 4-equivalent couplers. As the yellow coupler usable, such open-chain ketomethylene compounds as, e.g., pivalylacetanilide-type and benzoylacetanilide-type yellow couplers may be used.

As the magenta coupler, such compounds as pyrazolone-type, pyrazolotriazole-type, pyrazolinobenzimidazole-type and indazolone-type compounds may be used.

As the cyan coupler, those couplers having Formula [I] of the invention may be used, but may also be used, if necessary, together with different couplers than those having Formula [I].

And in order to improve the photographic characteristics, the light-sensitive material may contain a colorless dye forming coupler, the so-called competing coupler.

As the coupler to be used in the present invention, it is desirable to use those 2-equivalent couplers as described on pages 68 through 80 of Japanese Patent O.P.I. Publication No. 144727/1978 and those 4-equivalent couplers or colored couplers as described on pages 109 through 115 of the same publication.

The silver halide usable for the color light-sensitive material of the present invention includes those arbitrarily usable in ordinary silver halide photographic light-sensitive materials, such as silver chloride, silver bromide, silver iodide, silver chlorobromide, silver iodobromide, silver chloroiodide, and the like.

Such silver halide emulsions as mentioned above may be sensitized by known chemical sensitizers. As the chemical sensitizer, noble-metallic sensitizers, sulfur sensitizers, selenium sensitizers, and reduction sensitizers may be used singly or in combination.

As the binder for the emulsion layer, any known binder materials comprising various types of hydrophilic colloids which will be described later, may be used. Further, the silver halide emulsion layer used in the present invention may, if necessary, be spectrally sensitized by use of known sensitizing dyes such as cyanine dyes, merocyanine dyes or the like.

To the above-described silver halide emulsion, in order to prevent possible deterioration of the speed or possible occurrence of fog during the manufacture, storage or processing of the color light-sensitive material, may be added such various compounds as heterocyclic compounds, mercapto compounds, such as 1-phenyl-5-mercaptotetrazole, 3-methyl-benzothiazole, 4-hydroxy-6-methyl-1,3,3a,7-tetrazaindene, and metallic salts, and the like, in order to serve as a stabilizer or an antifoggant.

To the above silver halide emulsion may be added surface active agents singly or in a mixture thereof. As the surface active agent, various surface active agents may be added as a coating aid, as an emulsifying agent, for the purpose of improving the permeability of processing liquids, as a defoaming agent, as an antistatic agent, as an antiadhesive agent, and for the purpose of improving the photographic characteristics or of controlling the physical property.

The hardening of the emulsion may be effected in the usual manner in which a hardening agent or the like, for example, is used.

The color sensitive material of the present invention is produced by coating over a support that is excellent in the flatness and dimensionally stable during the manufacture or the processing of the light-sensitive material.

The support material usable in the present invention includes such films as of cellulose acetate, cellulose nitrate, polyvinyl acetal, polypropylene, polyethylene terephthalate, polyamide, polycarbonate, polystyrene, and polyethylene-laminated paper, polypropylene synthetic paper, baryta paper, and the like. These support materials may be arbitrarily selected according to uses of color sensitive materials.

These support materials are generally subjected to a subbing treatment in order to strengthen the adhesion thereof to the silver halide emulsion layer. The treatment method is to provide a subbing layer containing known undercoat materials on the support, and there may also be used such treatments as corona discharge treatment, ultraviolet irradiation treatment, flame treatment or the like.

The abovementioned nonlight-sensitive layers of the present invention include such layers well-known to those skilled in the art as having the functions of a protective layer, interlayer, filter layer, antihalation layer, and the like.

The hydrophilic colloid usable in these layers include gelatin, such gelatin derivatives as phenylcarbamylated galatin, acylated gelatin, phthalated gelatin, and the like, colloidal albumin, agar-agar, gum arabic, such cellulose derivatives as hydrolyzed cellulosed acetate, carboxymethyl cellulose, hydroxyethyl cellulose, methyl cellulose, and the like, acrylamide, imidated polyacrylamide, casein, polyvinyl alcohol polymers containing urethanecarboxylic acid group or cyanoacetyl group, such as, e.g., polyvinyl alcohol-vinylcyanoacetate copolymer, polyvinyl alcohol, polyvinyl pyrolidone, hydrolyzed polyvinyl acetate, polymers obtained by the polymerization of protein or saturated acylated protein with a monomer having vinyl group, and the like.

The nonlight-sensitive layer of the present invention may contain, as an ultraviolet absorbing agent, a benzotriazole, triazine, or benzophenone-type or acrylonitrile-type compound. Particularly a single or combined use of Tinuvin-Ps, -320, -326 and -328, manufactured by Ciba Geigy (AP) is desirable. And a reducing agent or oxidation inhibitor may also be combinedly used which is such as, e.g., a sulfite (sodium sulfite, ptoassium sulfite, etc.), a hydrogensulfite (sodium hydrogensulfite, potassium hydrogensulfite, etc.), a hydroxylamine (hydroxylamine, N-phenylhydroxylamine, etc.), a sulfinate (sodium phenylsulfinate, etc.), a hydrazine (N,N'-dimethylhydrazine, etc.), a reductone (ascorbic acid, etc.), an aromatic hydrocarbon having not less than one hydroxyl group (p-aminophenol, alkylhydroquinone, gallic acid, catechol, pyrogallol, resorcinol, 2,3-dihydroxynaphthalene, etc.), or the like.

Further, in order to increase the stability of the color light-sensitive material, into the nonlight-sensitive layer of the present invention may be incorporated a p-substituted phenol. The particularly preferred p-substituted phenols include alkyl-substituted hydroquinones, bishydroquinones, polymer-type hydroquinones, p-alkoxyphenols, phenolic compounds. Further, alkoxy or amyloxy derivatives of 6-chromanol or 6,6'-dihydroxy-2,2'-spirochroman may also be similarly used.

The above-mentioned various compounds may be incorporated also into the emulsion layer.

The color light-sensitive material of the invention can be developed in the well-known color developing processes, and the color developer for use in the processing of the color light-sensitive material of the present invention is used in the form of a developing agent-containing aqueous alkaline solution having a pH of not less than 8, preferably a pH of from 9 to 12. An aromatic primary amine developing agent as the developing agent herein means a compound which has a primary amine group on an aromatic ring and which is capable of developing an exposed silver halide or a precursor that forms such a compound.

The above-described developing agent is typified by p-phenylenediamine-type compounds, those preferred ones of which include 4-amino-N,N-diethylaniline, 3-methyl-4-amino-N,N-diethylaniline, 4-amino-N-ethyl-N-β-hydroxyethylaniline, 3-methyl-4-amino-N-ethyl-N- -hydroxyethylaniline; 3-methyl-4-amino-N-ethyl-N-β-methanesulfonamidoethylaniline, 3-methyl-4-amino-N-ethyl-N-β-methoxyethyl-4-amino-N,N-diethylaniline, 3-methoxy-4-amino-N-ethyl-N-β-hydroxyethylaninline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, and salts of these compounds such as sulfates, hydrochlorides, sulfites, p-toluenesulfonates, and the like. To a developer liquid containing any one of these color developing agents may, if necessary, be added various additives.

The color light-sensitive material of the present invention, after being exposed imagewise and color-developed, may be subjected to a bleaching treatment in a usual manner. This treatment may be either carried out concurrently with or separately from fixation. This bleaching liquid, by, if necessary, adding a fixing agent thereto, may be used as a bleach-fix bath. As the bleaching agent, various well-known compounds may be used, to which may be added various additives including bleaching accelerators.

The present invention can be realized in various types of color light-sensitive materials. One of the types is such that a light-sensitive material comprising a support having thereon an emulsion layer containing a nondiffusible coupler is processed in an alkaline developer solution containing an aromatic primary amine color developing agent to thereby form a water-insoluble or nondiffusible dye which is to remain inside the emulsion layer. Another type is such that a light-sensitive material comprising a support having thereon an emulsion layer containing a silver halide combined with a nondiffusible coupler is processed in an alkaline developer solution containing an aromatic primary amine color developing agent to thereby produce a dye soluble in an aqueous medium and diffusible, which dye can then be transferred onto an image receiving layer comprising a hydrophilic colloid; i.e., the diffusion transfer color process.

The color light-sensitive material of the present invention includes all kinds of color light-sensitive material such as color or negative film, color positive film, color reversal film, color photographic paper, and the like.

The present invention will be illustrated in detail with reference to examples below, but the embodiments of the present invention are not limited thereto.

EXAMPLE 1

A subbed triacetate base support was coated thereover with the following layers in the described order from the support side to thereby prepare samples 1 to 16.

Layer-1 . . . gelatin layer:

To an aqueous gelatin solution was added the following dispersed liquid-1, and further added saponin and a hardening agent 1,2-bis(vinyl-sulfonyl)ethane, and the resulting mixture was coated.

Layer-2 . . . silver halide emulsion layer:

To 1 mole of a silver iodobromide emulsion containing 6 mole % silver iodide was added the following dispersed liquid-2, and further added 4-hydroxy-6-methyl-1,3,3a,7-tetrazaindene, saponin and a hardening agent 1,2-bis(vinyl-sulfonyl)ethane, and the resulting mixture was coated.

Layer-3 . . . protective layer:

The same as Layer-1.

Dispersed liquid-1:

To a mixture of 10 g of each of the exemplified compounds given in Table 1 or a comparative compound with 5 ml of ethyl acetate were added 10 ml of a 10% aqueous solution of Alkanol B (alkylnaphthalenesulfonate, produced by DuPont) and 50 ml of 10% aqueous gelatin solution, and the resulting mixture was emulsified to be dispersed by means of a colloid mill.

Dispersed liquid-2:

Twenty grams of each of the exemplified cyan couplers given in Table 1 were added to a mixture liquid of 10 g of each of the exemplified compounds (of the present invention) given in Table 1 with 50 ml of ethyl acetate, and the resulting mixture was heated to 60° C. and dissolved completely. The obtained solution was mixed with 20 ml of a 10% aqueous Alkanol B solution and 100 ml of a 10% aqueous gelatin solution, and this mixture was emulsified to be dispersed by means of a colloid mill.

In addition, those layers with no compound ("none") in the respective column of Table 1 are of an aqueous gelatin solution containing saponin and a hardening agent alone.

Each of the thus obtained samples was allowed to stand over a period of one week under an atmospheric condition of a temperature of 40° C. with a relative humidity of 80%, and then exposed through an optical wedge to light in a normal manner, and after that, the exposed sample was subjected to the following development processes, thereby obtaining the results as shown in Table 1, wherein the "Density deterioration degree" and the "Speed deterioration degree" represent the differences in terms of the deteriorated percentages of the maximum color density and of the speed, respectively, of each sample between before and after being aged under the above-mentioned high temperature/-high humidity condition.

| Development processes (38° C.) | Processing time |
|---|---|
| Color development | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

The compositions of the processing liquids used in these processes are as follows:

| | |
|---|---|
| Color developer liquid composition: | |
| 4-amino-3-methyl-N—ethyl-N—(β-hydroxyethyl)-aniline sulfate | 4.8 g |
| Anhydrous sodium sulfite | 0.14 g |
| Hydroxyamine ½ sulfate | 1.98 g |
| Sulfuric acid | 0.74 g |
| Anhydrous potassium carbonate | 28.85 g |
| Anhydrous potassium hydrogencarbonate | 3.46 g |
| Anhydrous potassium sulfite | 5.10 g |
| Potassium bromide | 1.16 g |
| Sodium chloride | 0.14 g |
| Trisodium nitrilotriacetate, monohydrated | 1.20 g |
| Potassium hydroxide | 1.43 g |
| Water to make 1 liter | |
| Bleaching bath composition: | |
| Iron-ammonium ethylenediaminetetraacetate | 100.0 g |
| Ammonium ethylenediaminetetraacetate | 10.0 g |
| Glacial acetic acid | 10.0 ml |
| Ammonium bromide | 150.0 g |
| Water to make 1 liter | |
| Use aqueous ammonia to adjust the pH to 6.0 | |
| Fixing bath composition: | |
| Ammonium thiosulfate | 175.0 g |
| Anhydrous sodium sulfite | 8.6 g |
| Sodium metabisulfite | 2.3 g |
| Water to make 1 liter | |
| Use acetic acid to adjust the pH to 6.0 | |
| Stabilizing bath composition: | |
| Formalin (37% aqueous solution) | 1.5 ml |
| Koniducks (a product of Konishiroku Photo Industry Co., Ltd.) | 7.5 ml |
| Water to make 1 liter | |

TABLE 1

| Sample No. | Layer-1 Dispersed liquid-1 Compound having Formula [II] | Layer-2 Dispersed liquid-2 Coupler | Layer-2 Dispersed liquid-2 Compound having Formula [II] | Layer-3 Dispersed liquid-1 Compound having Formula [II] | Density deterioration degree (%) | Speed deterioration degree (%) | |
|---|---|---|---|---|---|---|---|
| 1 | None | A-3 | P-1 | P-1 | 0 | 0 | Invention |
| 2 | None | A-3 | P-1 | P-6 | 5 | 5 | |
| 3 | None | A-4 | P-1 | P-1 | 0 | 0 | |
| 4 | None | A-4 | P-6 | P-2 | 0 | 0 | |

TABLE 1-continued

| Sample No. | Layer-1 Dispersed liquid-1 Compound having Formula [II] | Layer-2 Dispersed liquid-2 Coupler | Layer-2 Dispersed liquid-2 Compound having Formula [II] | Layer-3 Dispersed liquid-1 Compound having Formula [II] | Density deterioration degree (%) | Speed deterioration degree (%) | |
|---|---|---|---|---|---|---|---|
| 5 | None | A-11 | P-6 | P-1 | 5 | 5 | |
| 6 | P-1 | A-3 | P-1 | None | 15 | 10 | |
| 7 | P-6 | A-4 | P-6 | None | 20 | 15 | |
| 8 | P-1 | A-11 | P-6 | None | 15 | 10 | |
| 9 | P-1 | A-3 | P-1 | P-1 | 0 | 0 | |
| 10 | P-6 | A-4 | P-6 | P-1 | 5 | 5 | |
| 11 | None | A-3 | P-1 | None | 50 | 40 | Non-invention |
| 12 | None | A-4 | P-6 | None | 45 | 40 | |
| 13 | None | A-3 | P-1 | TCP | 50 | 45 | |
| 14 | None | A-11 | P-1 | DELA | 50 | 40 | |
| 15 | TCP | A-3 | P-1 | None | 45 | 45 | |
| 16 | DELA | A-4 | P-6 | None | 50 | 45 | |

Comparative compounds:

TCP: Tricresyl phosphate

DELA: Diethyl laurylamide

From Table 1 it is apparent that samples 11 and 12 which contain no compounds of the present invention in the Layer-1 and Layer-3 thereof show large deterioration degrees of the maximum densities and of the speeds thereof after being aged for one week under the atmospheric condition of the temperature of 40° C./relative humidity of 80%, while on the other hand samples 1 to 10 which contain compounds of the present invention in the Layer-1 and/or Layer-3 thereof are so excellent that they have very small deteriorations of the maximum densities and of the speeds thereof. Particularly, the addition of them to Layer-3 (of each of samples 1 to 5 and 9 and 10) shows more excellent results than in the case of the addition to Layer-1 alone (of each of samples 6 to 8). The addition of the comparative compounds to Layer-1 or Layer-3 shows no improving effects.

EXAMPLE 2

A subbed polyethylene terephthalate film support was coated thereover with the following layers in the described order from the support side, thereby preparing sample 17.

Layer-1 . . . antihalation layer:

A black colloidal silver was dispersed into an aqueous gelatin solution, and the liquid was coated so that the coating quantity of gelatin is 3 g/m$^2$ and that of silver is 0.3 g/m$^2$.

Layer-2 . . . interlayer:

An aqueous gelatin solution was coated so that the dried thickness thereof is 1.0$\mu$.

Layer-3 . . . red-sensitive low-speed silver halide emulsion layer:

A silver iodobromide emulsion containing 8.5 mole% of silver iodide (mean particle size 0.7$\mu$; containing 0.25 mole of silver halide and 40 g of gelatin per kg of the emulsion) was prepared in a usual manner. 1 kg of this emulsion was chemically sensitized by the addition of a gold and sulfur sensitizers, and to this were further added as red sensitivity-providing spectrally sensitizing dyes 9-ethyl-3,3'-di-(3-sulfopropyl)-4,5,4',5'-dibenzothiacarbocyanine hydroxide anhydride, 5,5'-dichloro-9-ethyl-3,3'-di(3-sulfopropyl)thiacarbocyanine hydroxide anhydride, and 5,5'-dichloro-3,9-diethyl-3-(4-sulfobutyl)oxythiacarbocyanine hydroxide anhydride, and further added 0.25 g of 4-hydroxy-6-methyl-1,3,3a,7-tetrazaindene, 20 mg of 1-phenyl-5-mercaptotetrazole, and 0.2 g of polyvinylpyrolidone, and further 500 ml of the following dispersed material [C-1]. The thus obtained red-sensitive low-speed silver halide emulsion was coated so that the dried thickness thereof is 3.0$\mu$.

Layer-4 . . . interlayer:

The same as Layer-2.

Layer-5 . . . red-sensitive high-speed silver halide emulsion layer:

A silver iodobromide emulsion containing 7 mole% of silver iodide (mean particle size 1.0$\mu$; containing 0.25 mole of silver halide and 30 g of gelatin per kg of the emulsion) was prepared in a usual manner. 1 kg of this emulsion was chemically sensitized by the addition of gold and sulfur sensitizers. To this were added as red sensitivity-providing spectrally sensitizing dyes 9-ethyl-3,3'-di-(3-sulfopropyl)-4,5,4',5'-dibenzothiacarbocyanine hydroxide anhydride, 5,5'-dichloro-9-ethyl-3,3'-di-(3-sulfopropyl)thiacarbocyanine hydroxide anhydride, and 5,5'-dichloro-3',9-diethyl-3-(4-sulfobutyl)oxathiacarbocyanine hydroxide anhydride, and further added 0.25 g of 4-hydroxy-6-methyl-1,3,3a,7-tetrazaindene, 8 mg of 1-phenyl-5-mercaptotetrazole, and 0.2 g of polyvinylpyrolidone, and further 500 ml of the following dispersed material [C-2]. The thus prepared red-sensitive high-speed silver halide emulsion was coated so that the dried thickness thereof is 0.2$\mu$.

Layer-6: Interlayer

The same as Layer-2

Layer-7 . . . green-sensitive low-speed silver halide emulsion layer:

A silver iodobromide emulsion containing 6 mole% of silver iodide (mean particle size 0.3$\mu$; containing 0.25 mole of silver halide and 40 g of gelatin per kg of the emulsion) was prepared in a usual manner. 1 kg of this emulsion was chemically sensitized by the addition of gold and sulfur sensitizers. To this were further added as green sensitivity-providing spectrally sensitizing dyes 5,5'-dichloro-9-ethyl-3,3'-di-(3-sulfopropyl)oxacarbocyanine hydroxide anhydride, 5,5'-diphenyl-9-ethyl-3,3'-di-(3-sulfopropyl)oxacarbocyanine anhydride, and 9-ethyl-3,3'-di-(3-sulfopropyl)-5,6,5',6'-dibenzoxacarbocyanine hydroxide anhydride, and further added 0.25 g of 4-hydroxy-6-methyl-1,3,3a,7-tetrazaindene, 20 ml of 1-phenyl-5-mercaptotetrazole, and 0.2 g of polyvinylpyrolidone to thereby prepare a sensitized emulsion-A. Further, a silver iodobromide emulsion containing 6 mole% of silver iodide (mean particle size 0.7$\mu$; containing 0.25 mole of silver halide and 40 g of gelatin per kg of the emulsion) was prepared in a usual manner, and this was sensitized in the same manner as in emulsion-A by using the same sensitizers and stabilizers in one half the amount used in above to thereby prepare a separately sensitized emulsion-B. And the thus prepared emulsions A and B were mixed in the proportion of 1:1. To 1 kg of the mixed emulsion were then added 500 ml of the following dispersed material [M-1] to thereby prepare a green-sensitive low-speed silver halide emulsion (1), which was then coated so that the dried thickness thereof is 3.0μ.

Layer-8 . . . interlayer

The same as Layer-2.

Layer-9 . . . green-sensitive high-speed silver halide emulsion layer:

A silver iodobromide emulsion containing 7 mole% of silver iodide (mean particle size 1.2μ; containing 0.25 mole of silver halide and 30 g of gelatin per kg of the emulsion) was prepared in a usual manner. 1 kg of this emulsion was chemically sensitized by use of gold and sulfur sensitizers, and to this were further added as green sensitivity providing spectrally sensitizing dyes 5,5'-dichloro-9-ethyl-3,3'-di(3-sulfopropyl)oxacarbocyanine hydroxide anhydride, 5,5'-diphenyl-3,3'-di-(3-sulfopropyl)oxacarbocyanine anhydride, and 9-ethyl-3,3'-di(3-sulfopropyl)-5,6,5',6'-dibenzoxacarbocyanine hydroxide anhydride, and further added 0.25 g of 4-hydroxy-6-methyl-1,3,3a,7-tetrazaindene, 5 mg of 1-phenyl-5-mercaptotetrazole, and 0.2 g of polyvinylpyrolidone, and further 200 ml of the following dispersed material [M-2] to thereby prepare a green-sensitive high-speed silver halide emulsion, which was then coated so that the dried thickness thereof is 2.0μ.

Layer-10: Interlayer

The same as Layer-2

Layer-11 . . . yellow filter layer:

To an yellow colloidal silver-dispersed aqueous gelatin solution was added a dispersed liquid prepared by dispersing into an aqueous gelatin solution containing 0.3 g of sodium triisopropyl-naphthalenesulfonate a solution of 3 g of 2,5-t-octyl-hydroquinone and 1.5 g of di-2-ethyl-hexyl phthalate dissolved into 10 ml of ethyl acetate, and this was coated so that the coated amount of gelatin is 0.9 g/m$^2$ and that of 2,5-di-t-octyl-hydroquinone is 0.10 g/m$^2$ with the dried thickness thereof being 1.2μ.

Layer-12 . . . blue-sensitive low-speed silver halide emulsion layer:

A silver iodobromide emulsion containing 6 mole% of silver iodide (mean particle size 0.6μ; containing 0.25 mole of silver halide and 80 g of gelatin per kg of the emulsion) was prepared in a usual manner. 1 kg of this emulsion was chemically sensitized by the addition of gold and sulfur sensitizers, and to this were further added as a blue sensitivity providing sensitizing dye 5,5'-dimethoxy-3,3'-di-(3-sulfopropyl)thiacyanine hydroxide anhydride, 0.25 g of 4-hydroxy-6-methyl-1,3,3a,7-tetrazaindene, 20 mg of 1-phenyl-5-mercaptotetrazole and 0.2 g of polyvinylpyrolidone and further 1000 ml of the following dispersed material [Y-1]. The thus obtained blue-sensitive low-speed silver halide emulsion was coated so that the dried thickness thereof is 3.0μ, Layer-13 . . . blue-sensitive high-speed silver halide emulsion layer:

A silver iodobromide emulsion containing 5 mole% of silver iodide (mean particle size 1.0μ; containing 0.25 mole of silver halide and 40 g of gelatin per kg of the emulsion) was prepared in a usual way. 1 kg of this emulsion was chemically sensitized by the addition of gold and sulfur sensitizers, and to this was added as a blue sensitivity providing sensitizing dye 5,5'-dimethoxy-3,3'-di-(3-sulfopropyl)thiacyanine hydroxide anhydride, and were further added 0.25 g of 4-hydroxy-6-methyl-1,3,3a,7-tetrazaindene, 10 mg of 1-phenyl-5-mercaptotetrazole and 0.2 g of polyvinylpyrolidone, and further 150 ml of the following dispersed material [Y-1]. The thus obtained blue-sensitive high-speed silver halide emulsion was coated so that the dried thickness thereof is 2.0μ.

Layer-14 . . . interlayer

A mixture of 2 g of di-2-ethyl-hexyl phthalate, 2 g of 2-[3-cyano-3-(n-dodecylaminocarbonyl)allylidene]1-ethylpyrrolidine and 2 ml of ethyl acetate was dispersed into an aqueous gelatin solution containing 0.6 g of sodium triisopropylnaphthalenesulfonate to thereby prepare a dispersed liquid, and to the liquid was further added a fine-grained silver iodobromide with a mean particle size of 0.08μ, and this was coated so that the coated amount of gelatin is 1.0 g/m$^2$ and that of silver is 0.6 g/m$^2$ with the dried thickness being 1.0μ.

Layer-15 . . . protective layer:

An aqueous gelatin solution containing per 100 ml 4 g of gelatin and 0.2 g of 1,2-bisvinyl-sulfonylethane was coated so that the coated amount of gelatin is 1.3 g/m$^2$ with the dried thickness thereof being 1.2μ.

In addition, the dispersed materials used in the above emulsion layers were prepared in the following manners:

Dispersed material [C-1]:

50 g of the foregoing cyan coupler (A-3), 10 g of the following cyan coupler (C-1), 2.0 g of the following DIR compound (D-1) and 0.5 g of dodecyl gallate were added to and dissolved by heating into 120 ml of a mixture of the foregoing exemplified compound (P-1), diethyl-laurylamide and ethyl acetate (ratio by weight 4:1:6), and the resulting solution was added to 400 ml of a 7.5% aqueous gelatin solution containing 2 g of sodium triisopropylnaphthalenesulfonate, and the mixture was emulsified to be dispersed by a colloid mill and then prepared to make 1000 ml.

Dispersed material [C-2]:

5 g of the foregoing cyan coupler (A-3), 10 g of the following cyan coupler (C-2), 2.0 g of the following DIR compound (D-1) and 0.5 g of dodecyl gallate were added to and dissolved by heating into 60 ml of a mixture of the foregoing exemplified compound (P-1), diethyl-laurylamide and ethyl acetate (ration by weight 4:1:6), and the mixture was added to 400 ml of a 7.5% aqueous gelatin solution containing 2 g of sodium triisopropylnaphthalenesulfonate. The resulting mixture was emulsified to be dispersed by means of a colloid mill and then prepared to make 1000 ml.

Dispersed material [M-1]:

54 g of the following magenta coupler (M-1), 14 g of colored magenta coupler (CM-1), 0.5 g of DIR compound (D-2), 0.5 g of DIR compound (D-3), 0.5 g of dodecyl gallate and 2 g of 2,5-di-t-octylhydroquinone were dissolved into a mixture of 68 g of TCP and 280 ml of EA, and the mixture was added to 500 ml of a 7.5% aqueous gelatin solution containing 8 g of sodium triisopropylnaphthalenesulfonate, and the resulting mixture was emulsified to be dispersed by means of a colloid mill, and then prepared to make 1000 ml.

Dispersed material [M-2]:

20 g of the following magenta coupler (M-1), 4 g of colored magenta coupler (CM-1) and 1 g of 2,5-di-t-octyl-hydroquinone, 0.3 g of DIR compound (D-2) were dissolved into a mixture of 70 g of TCP with 280 ml of EA, and the mixture was added to 500 ml of a 7.5% aqueous gelatin solution containing 8 g of sodium triisopropylnaphthalenesulfonate, and the resulting mixture was emulsified to be dispersed by means of a colloid mill and then prepared to make 1000 ml.

Dispersed material [Y-1]:

50 g of the following coupler (Y-1) and 0.5 g of DIR compound (D-2) were dissolved into 150 ml of a mixture of 25 g of TCP with 150 ml of EA, and this solution was added to 500 ml of a 7.5 aqueous gelatin solution containing 8 g of sodium triisopropylnaphthalenesulfonate, and the mixture was emulsified to be dispersed by means of a colloid mill, and then prepared to make 1000 ml.

The compounds used

Cyan coupler (C-1):
1-hydroxy-2-[δ-(2,4-di-tert-amylphenoxy)butyl]naphthoamide.

Cyan coupler (C-2):
1-hydroxy-4-[β-methoxyethylaminocarbonylmethoxy)-N-[δ-(2,4-di-t-amylphenoxy)butyl]-2-naphthoamide.

Magenta coupler (M-1):
1-(2,4,6-trichloro)phenyl-3-[3-(2,4-di-tert-amylphenoxy)acetamido]benzamido-5-pyrazolone.

Colored magenta coupler (CM-1):
1-(2,4,6-trichloro)phenyl-3-[3-(octadecylsuccinimido)-2-chloro]anilino-4-(α-naphthylazo)-5-pyrazolone.

Yellow coupler (Y-1):
α-pivaloyl-α-(1-benzyl-2-phenyl-3,5-dioxo-1,2,4-triazolidine-4-yl)-2-chloro-5-[α-(dodecyloxycarbonyl)pentoxycarbonyl]acetanilide.

DIR compound (D-1):
4-[4-1(ethyl-5-tetrazole)thiomethyl-3-methyl-1-phenyl-5-pyrazolyloxy]-1-hydroxy-N-[4-(2,4-di-tert-pentylphenoxy)butyl]-2-naphthoamide.

DIR compound (D-2):
β-{4-[1-(p-nitrophenyl)-4-(1-phenyl-5-tetrazolyl)thiomethyl-3-undecyl-5-pyrazolyloxy]-1-hydroxt-2-naphthoamido propionic acid.

DIR compound (D-3):
β-{4-[1-(p-nitrophenyl)-4-(1-ethyl-5-tetrazolyl)thiomethyl-3-undecyl-5-pyrazolyloxy]-1-hydroxy-2-naphthoamido propionic acid.

Further, to Layer-2, Layer-4 and Layer-6 was added a dispersed liquid of compound P-1 (the same as the dispersed liquid-1 in Example 1) of the invention, thereby preparing sample-18.

Each of these high-speed multicolor light-sensitive materials (samples-17 and -18) was allowed to stand over a period of three weeks in a place where the air was conditioned at a temperature of 40° C./relative humidity of 80%, and then, together with the unaged same sample, exposed through an optical wedge with a red filter attached thereto, and after that, both the aged and unaged samples were processed in the same manner as in Example 1. The obtained results are as shown in Table 2. The "density deterioration degree (%)" and the "speed deterioration degree (%)" in the table are as defined in Example 1.

TABLE 2

| Sample No. | Layer-2 Dispersed liquid P-1 | Layer-4 Dispersed liquid P-1 | Layer-6 Dispersed liquid P-1 | Density deterioration degree (%) | Speed deterioration degree (%) | |
|---|---|---|---|---|---|---|
| 17 | None | None | None | 50 | 40 | Non-invention |
| 18 | Added | Added | Added | 5 | 5 | Invention |

From Table 2 it is apparent that while sample-17 which is outside the present invention shows large density and speed deterioration degrees, sample-18 of the present invention is excellent showing much small density and speed deterioration degrees as compared to sample-17.

What is claimed is:

1. A silver halide color photographic light-sensitive material comprising a support having thereon at least one silver halide emulsion layer and a non-light-sensitive layer adjacent to said silver halide emulsion layer, wherein said silver halide emulsion layer contains a cyan coupler having the following Formula [I] and a compound having the following Formula [II], and further said non-light-sensitive layer contains a compound having said Formula [II];

Formula [I]

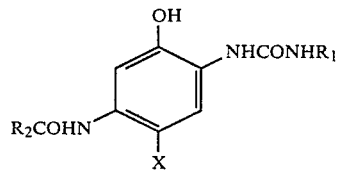

wherein X is a hydrogen atom or a group which can be split off by the coupling reaction with the oxidized product of an aromatic primary amine color developing agent; $R_1$ is an aryl group or a heterocyclic group; and $R_2$ is a ballasting group necessary to cause said cyan coupler having said Formula [I] and the cyan dye formed from said cyan coupler to be nondiffusible;

Formula [II]

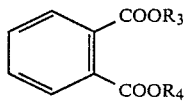

wherein $R_3$ and $R_4$ each is an alkyl group, an alkenyl group, or a cycloalkyl group each having from 3 to 20 carbon atoms, or an aryl group having from 6 to 20 carbon atoms.

2. A silver halide color photographic light-sensitive material as claimed in claim 1, wherein said cyan coupler is a compound having the following formula [Ia] or [Ib];

Formula [Ia]

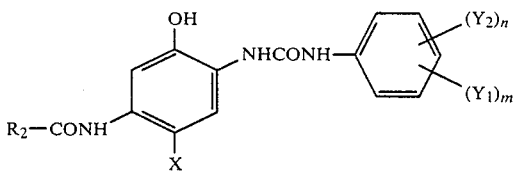

-continued

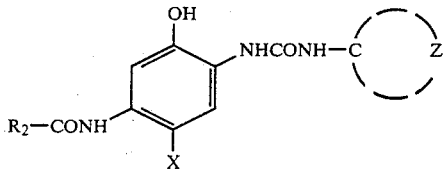

Formula [Ib]

wherein $Y_1$ is trifluoromethyl, nitro, cyano or a group represented by —COR, —COOR, $—SO_2R$, $—SO_2OR$,

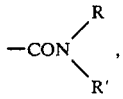

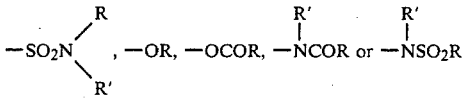

wherein R is an aliphatic group or an aromatic group; R′ is a hydrogen atom or one of the groups represented by R; and R and R′ may couple to each other to form a 5- or 6-member ring; $Y_2$ is a monovalent group; m is an integer of from 1 to 3; n is an integer of 0 to 3; Z is a group of nonmetallic atoms necessary to form a heterocyclic group or naphthyl group; $R_2$ represents an aliphatic or aromatic group necessary to cause the cyan coupler having Formula [Ia] or [Ib] and the cyan dye formed therefrom to be nondiffusible; and X is a hydrogen atom or a group which can be split off during the coupling reaction thereof with the oxidized product of a color developing agent.

3. A silver halide color photographic light-sensitive material as claimed in claim 2, wherein an aliphatic group represented by R respectively in —COR, —COOR, $—SO_2R$, $—SO_2OR$,

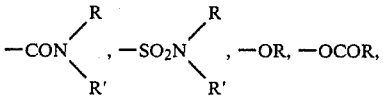

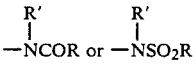

represented by $Y_1$ in the Formula [Ia], said aliphatic group is an alkyl group having 1 to 10 carbon atoms, and said aromatic group is a phenyl group; said monovalent group represented by $Y_2$ is an aliphatic group, an aromatic group, a halogen atom, an amino group, a hydroxyl group or a substituent represented by $Y_1$.

4. A silver halide color photographic light-sensitive material as claimed in claim 2, wherein said group of nonmetallic atoms necessary to form a heterocyclic group, represented by Z in said Formula [Ib], is a group of those necessary to form a 5- or 6-member heterocyclic ring containing 1 to 4 nitrogen, oxygen or sulfur atoms.

5. A silver halide color photographic light-sensitive material as claimed in claim 2, wherein said aliphatic group represented by $R_2$ in said Formulae [Ia] and [Ib], is an alkyl group having 4 to 30 carbon atoms.

6. A silver halide color photographic light-sensitive material as claimed in claim 1, wherein said alkyl group represented by $R_3$ and $R_4$ respectively in said compound having Formula [II] is a straight-chain or a branched-chain alkyl group having 4 to 12 carbon atoms, and said aryl group represented by $R_3$ and $R_4$ in said compound having the same formula is an aryl group having 6 to 12 carbon atoms.

7. A silver halide color photographic light-sensitive material as claimed in claim 6, wherein said alkyl group represented by $R_3$ and $R_4$ each is a butyl group.

8. A silver halide color photographic light-sensitive material as claimed in claim 1, wherein said non-light-sensitive layer adjacent to said silver halide emulsion layer is located farther than the emulsion layer from the support.

9. A silver halide color photographic light-sensitive material as claimed in claim 1, wherein said cyan coupler having said Formula [I] is added, in a quantity of $1\times10^{-2}$ to 1.0 mole per mole of silver halide, into said silver halide emulsion layer.

10. A silver halide color photographic light-sensitive material as claimed in claim 1, wherein said compound having said Formula [II] is added, in a quantity of 0.2 to 3 g per g of said cyan coupler having said Formula [I], into said silver halide emulsion layer.

11. A silver halide color photographic light-sensitive material as claimed in claim 1, wherein said compound having said Formula [II] is added to said non-light-sensitive layer, in a quantity of 20 to 200% by weight of the adding quantity thereof per unit area of said silver halide emulsion layer.

12. A silver halide color photographic light-sensitive material as claimed in 12, wherein said compound having Formula [II] is added to said non-light-sensitive layer, in a quantity of 50–150% by weight of adding quantity thereof per unit area of said silver halide emulsion layer.

13. A silver halide color photographic light-sensitive material according to claim 2, wherein said $R_2$ shown respectively in said Formulae [Ia] and [Ib] is a group having the following Formula [Ic],

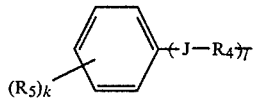

wherein J represents oxygen or sulfur; k is an integer of from 0 to 4, l is an integer of 0 or 1, where k is not less than 2; $R_4$ is a straight-chain or branched-chain alkylene group having from 1 to 20 carbon atoms; $R_5$ is a monovalent group.

14. A silver halide color photographic light-sensitive material according to claim 14, wherein said monovalent group represented by $R_5$ is an alkyl group, having 3 to 10 carbon atoms.

15. A silver halide color photographic light-sensitive material according to claim 2, wherein Y, is $—SO_2R$ wherein R is the same group as defined in claim 2, n is 0 and m is 1.

* * * * *

UNITED STATES PATENT AND TRADEMARK OFFICE

CERTIFICATE OF CORRECTION

PATENT NO. : 4,518,683

DATED : May 21, 1985

INVENTOR(S) : Kazuo KATO, Fumio HAMADA and Kenji ITO

It is certified that error appears in the above—identified patent and that said Letters Patent is hereby corrected as shown below:

Claim 13, line 5, next to the formula, insert --Formula [Ic]--.

Signed and Sealed this

*Sixth* Day of *May 1986*

[SEAL]

*Attest:*

DONALD J. QUIGG

*Attesting Officer*

*Commissioner of Patents and Trademarks*